US011245973B2

(12) United States Patent
Hansen

(10) Patent No.: US 11,245,973 B2
(45) Date of Patent: Feb. 8, 2022

(54) HEARING DEVICE WITH ACTIVE VENT CLICK COMPENSATION

(71) Applicant: GN Hearing A/S, Ballerup (DK)

(72) Inventor: Jonas Raun Hansen, Roskilde (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/371,898

(22) Filed: Jul. 9, 2021

(65) Prior Publication Data

US 2022/0014835 A1 Jan. 13, 2022

(30) Foreign Application Priority Data

Jul. 9, 2020 (DK) ..... PA202070471

(51) Int. Cl.
*H04R 25/00* (2006.01)
*H04R 1/10* (2006.01)

(52) U.S. Cl.
CPC ..... *H04R 1/1016* (2013.01); *H04R 2420/07* (2013.01); *H04R 2460/11* (2013.01)

(58) Field of Classification Search
CPC ..... H04R 1/1016; H04R 2420/07; H04R 2420/11
USPC ..... 381/380
See application file for complete search history.

(56) References Cited

U.S. PATENT DOCUMENTS 8,655,003 B2 2/2014 Duisters et al.
10,687,153 B2 6/2020 Albahri et al.
2010/0232622 A1 9/2010 Kasanmascheff et al.
2012/0082335 A1 4/2012 Duisters
2014/0169603 A1 6/2014 Sacha
2019/0246219 A1 8/2019 Lafort

FOREIGN PATENT DOCUMENTS

EP 1289337 A2 * 3/2003 ..... H04R 25/652
EP 2835987 2/2015
EP 3716649 9/2020
WO WO-2012149970 A1 * 11/2012 ..... H04R 25/652
WO WO 2015/101505 7/2015

OTHER PUBLICATIONS

Examination Report for Danish Patent Application No. PA 2020 70471 dated Jan. 6, 2021.
Extended European Search Report for EP Patent Appln. No. 21180825.8 dated Nov. 30, 2021.

* cited by examiner

*Primary Examiner* — Phylesha Dabney
(74) *Attorney, Agent, or Firm* — Vista IP Law Group, LLP

(57) ABSTRACT

A hearing device has an ear plug for insertion into an ear canal of a user of the hearing device. The ear plug comprises a vent having a vent valve device configured to open or close the vent. The hearing device is configured to obtain a predetermined audio signal representing a sound emitted by the vent when the vent valve device is being manipulated. The signal processor is configured to output a phase-inverted version of the predetermined audio signal to the receiver substantially at the same time as the vent valve device is manipulated, thus cancelling out the sound of the vent. The predetermined audio signal may be obtained during manufacture of the hearing device or it may be picked up by an in-the-ear microphone. Accordingly, the unpleasant sound of a vent being opened or closed while the hearing device is worn by a user is reduced or eliminated.

15 Claims, 5 Drawing Sheets

HEARING DEVICE WITH ACTIVE VENT CLICK COMPENSATION

RELATED APPLICATION DATA

This application claims priority to, and the benefit of, Danish Patent Application No. PA202070471 filed Jul. 9, 2020. The entire disclosure of the above application is expressly incorporated by reference herein.

FIELD

The present application relates to hearing devices. More specifically, it relates to hearing devices having controllable vents.

BACKGROUND

A hearing device is a tiny, electronic device adapted for providing sound to, or alleviating a hearing loss of, a person. This is usually done by amplifying sounds from the vicinity picked up by one or more microphones in the hearing device according to a prescription and reproducing the sounds acoustically by a small loudspeaker in the hearing device denoted a receiver. The prescription is used to adapt the amplification of the hearing device to alleviate a hearing loss of the person in such a way that frequencies hard to perceive by the person are amplified to a level above the person's hearing threshold at those frequencies.

Contemporary hearing devices have the capability of performing amplification in the digital domain by sampling analog signals from the microphones and converting them into digital signals by virtue of an analog-to-digital converter. The digital signals are then fed to a digital signal processor in the hearing device for processing, and the processed, digital signals are then converted into an electrical signal suitable for driving the receiver, reproducing the processed, electrical signals as sound. Processing signals in the digital domain has several advantages, mainly that the physical size of the electronics of the hearing device may be kept very small regardless of the power and capabilities of the hearing device. A desired change in the operation of the hearing device, say, a changed prescription, is just a matter of loading and executing a different program or changing key processing parameters in the signal processor. Signal processing which may be difficult or downright impossible to perform in the analog domain, e.g. feedback suppression, are also comparatively easy to execute in the digital domain. An added benefit of digital signal processing is the easy access to logical on/off operations, e.g. for temporarily activating or suspending selected parts of the hearing device during use.

The recent inclusion of wireless communication in hearing devices makes remote controlling a hearing device possible and provides wireless streaming of sound signals from external sources such as cellphones or TV-sets, typically using a digital communications protocol suitable for short-range, low-power communications. The remote control makes it possible to adjust the amplification of the hearing device to suit a particular situation and allows specific operational modes to be selected by the user, such as modes suited for conversations, concerts, outdoors or the like. Some hearing devices with the capability of receiving streamed audio may lack the provision of a prescription amplification.

Most hearing devices comprise an ear plug formed as a plug or shell manufactured to fit snugly in the ear canal of the user, e.g. by manufacturing the ear plug according to an impression made of the ear canal or by manufacturing the ear plug as a generically shaped dome made from a resilient material, e.g. a silicone-based elastomeric material. The ear plug is usually made from a plastic material with a smooth outer surface for comfort, stability, and hygienic reasons. In one type of hearing device, the receiver is mounted in a housing worn behind the user's ear and connected to the ear plug fitting in the ear canal via a short piece of tubing conducting sound from the receiver in the housing to an outlet in the ear canal for reproduction. This type is known as a behind-the-ear (BTE) hearing device. In a related type of hearing device, the receiver is instead mounted within the ear plug and connected to the hearing device housing via wires. This type is known as a receiver-in-ear (RIE) hearing device. In another type of hearing device, the electronics and microphone are made sufficiently small to be placed entirely in the ear plug itself, forming an integral unit for placement in—or completely within—the ear canal. These devices are known as in-the-ear (ITE) or completely-in-canal (CIC) hearing devices. The purpose of the snug fit of the ear plug in the ear canal is partly to make the ear plug sit comfortably and securely in the ear canal during use and partly to exclude the amplified sounds from the receiver from reaching the hearing device microphones, which could result in unpleasant feedback, or "howling".

However, the snug fit of the ear plug in the ear canal also presents some problems. The ear plug forms a closed cavity in the ear canal resulting in moisture building up in the ear canal. This presents a hazard to the hearing device electronics and may be uncomfortable to the user. The closed cavity also produces an effect known as occlusion, or the "plugged-ears"-effect, which may be uncomfortable to the user, especially because the perception of the user's own voice changes dramatically due to this effect. Both problems may be alleviated by placing a throughgoing, elongate canal, denoted a vent, in the ear plug during manufacture of the hearing device, providing a passageway for air and moisture from the ear canal to the outside of the ear plug. The dimensions of the vent are usually adapted to fit the type and severity of the hearing loss to be compensated by the hearing device.

A vent in a hearing device reduces occlusion and increases comfort, as discussed in the foregoing. The tradeoff is a decreased performance with respect to directionality and low-frequency reproduction, both factors having a huge influence on the sound quality of the hearing device, especially when listening to music. A vent may also compromise the feedback path of the hearing device, although this may be counteracted to some extent by special feedback suppression algorithms executed by the signal processor of the hearing device. It is therefore beneficial to make the vent in the ear plug capable of changing from being open to being closed according to the immediate needs of the user, e.g. having the vent closed if the user wants to listen to music and open if the user wants to participate in a conversation.

In some hearing devices, the ear plug is replaced with a dome made from a resilient material which conforms to the ear canal during use. Such a dome has the advantage of being very light and comfortable compared to an ear plug. The dome may have an open or a closed configuration, the open configuration providing the functionality of a vent in an ear plug, and the closed configuration providing the functionality of a closed ear plug without a vent.

Recently, several hearing device manufacturers have proposed active vents enabling opening or closing the vent of the ear plug or dome during use of the hearing device, i.e. by providing an electrically operated vent valve device for being manipulated by the user. Some of the proposed active vent valve devices are devised as bi-stable vent valve devices. A bi-stable vent valve device typically opens a passageway in a vent when a current is applied in one direction through the vent valve device and closes the passageway in the vent when a current is applied in the opposite direction through the vent valve device. A signal is applied to the vent valve device as a current of brief duration, e.g. a couple of milliseconds, and having sufficient strength to change the position of the vent valve device. Such a vent valve device thus only need the provision of an electrical signal when the vent valve device is being switched from an open to a closed state, or vice versa, thus only drawing electrical current from the hearing aid battery when the state of the vent valve device is changed. Resilient domes capable of being opened or closed electrically in a similar manner have also been proposed. Further details of the mechanism for opening or closing the vent valve device electrically is outside the scope of this application.

From EP 2835987-B1 it is known to change the acoustic impedance of a vent in a hearing device by opening or closing a vent valve device. By using an electromagnetic actuator operable by the user, the vent may be set in a closed position, a half-open position, or an open position according to requirements, i.e. this vent valve device is a tri-stable device. However, EP 2835987-B1 is silent on the rate with which the vent valve device may change its acoustic impedance and does not disclose compensational means for alleviating any sonic discomfort to the user when the vent is opened or closed.

The vent valve device activation usually gives off a quite audible click sound in the ear canal of the user whenever the vent is opened or closed, since the movement of the valve device is rather rapid, due to a correspondingly rapid pressure change inside the ear canal caused by the vent valve device. Such a click sound may be very uncomfortable to the user and may also direct the attention towards the occlusion experienced when the vent valve device closes the vent. It is therefore desirable to provide some sort of compensation for the clicking sound emitted by the vent valve device when the vent is opened or closed. In this application, the concepts 'sound' and 'sound wave' are used interchangeably to describe a pressure change in a volume of air, in this case the air trapped within the ear canal by the ear plug of the hearing device.

SUMMARY

According to a first embodiment, a hearing device is devised, said hearing device having an ear plug for insertion into an ear canal of a user of the hearing device, the hearing device comprising a first microphone, a signal processor, a memory, a controller and a receiver, the ear plug comprising a vent having a vent valve device configured to open or close the vent, the controller being configured to electrically manipulate the vent valve device to a first position or a second position based on a first signal from the signal processor, wherein the hearing device is configured to obtain a predetermined audio signal representing a sound emitted by the vent when the vent valve device is manipulated between the first position and the second position, and configured to store the predetermined audio signal in the memory, and wherein the signal processor is configured to access the predetermined audio signal in the memory and output a phase-inverted version of the predetermined audio signal to the receiver substantially at the same time as the vent valve device is manipulated.

In this manner, vent click compensation is provided by employing the receiver of the hearing device to compensate for the pressure change resulting from the vent valve device moving by making the receiver diaphragm move in the opposite direction of the vent valve device synchronously with the movement of the vent valve device by the same amount, thus producing a sound wave of opposite polarity, thereby canceling out the sound emitted by the vent. Hence, when the vent valve device moves a certain distance in one direction, the receiver will move the same distance in the opposite direction at substantially the same time and thereby move a similar amount of air in the opposite direction in order to compensate for the momentary over/under-pressure generated by the vent valve device movement, the net result being that the sum of the contribution from the movement of the vent valve device and the contribution from the receiver producing the phase-inverted version of the predetermined audio signal is zero, or close to zero. Other sounds reproduced by the receiver when the vent click is compensated in this way are not affected. The active vent is controlled by the signal processor, and the vent click compensation signal is therefore advantageously also generated by the signal processor.

It is a well-known principle to cancel out a given sound wave by simultaneously providing another sound wave having the same shape and amplitude, but with the phase inverted, as the given sound wave. When the sound of the vent when the vent valve device is being manipulated is reproduced with its phase inverted substantially at the same time as the vent valve device itself is manipulated, the sound emitted by the vent at that moment in time will be cancelled out. The term 'substantially at the same time' is here defined to mean that the phase-inverted sound wave occurs within less than 1 ms before or after the sound emitted by the vent when the vent valve device is manipulated, preferably within less than 100 μs before or after the sound emitted by the vent when the vent valve device is manipulated, more preferably within less than 10 μs before or after the sound emitted by the vent when the vent valve device is manipulated.

In a preferred embodiment, of the hearing device, the phase-inverted version of the predetermined audio signal output by the signal processor when the vent valve device is manipulated to the first position is different from the phase-inverted version of the predetermined audio signal output by the signal processor when the vent valve device is manipulated to the second position. This has the advantage that the sound produced by the receiver is different for the two positions the vent valve device can assume, i.e. a first sound is produced when the vent valve device is manipulated from an open to a closed position, and a second sound is produced when the vent valve device is manipulated from a closed to an open position. The difference between the first sound and the second sound may comprise the second sound having a different phase, a different (e.g. inverted) amplitude or a different spectral composition from the first sound. The sound signal representing a sound of the vent valve device being manipulated to the first position may be referred to as a first sound signal. A sound of the vent valve device being manipulated to the second position may be referred to as a second sound signal. For example, when the first position of the vent valve device is a closed position and the second position of the vent valve device is an open position, a first sound signal representing a sound of the vent valve device being manipulated from an open to a closed position is therefore beneficially stored in hearing device memory together with a second sound signal representing a sound of the vent valve device being manipulated from a closed to an open position. For example, when the first position of the vent valve device is an open position and the second position of the vent valve device is a closed position, a first sound signal representing a sound of the vent valve device being manipulated from a closed to an open position is therefore beneficially stored in hearing device memory together with a second sound signal representing a sound of the vent valve device being manipulated from an open to a closed position.

In some embodiments, the receiver is arranged in the ear plug of the hearing device. These embodiments may be receiver-in-ear (RIE) or in-the-ear (ITE) hearing devices. In this context, such hearing devices provide the benefit of having the receiver very close to the vent, thus simplifying the synchronicity of sending out the phase-inverted, predetermined audio signal to the receiver for simultaneously compensating the vent click sound.

In contrast, in some BTE hearing devices, the receiver is usually mounted in the BTE housing and provides its sound output via a piece of tubing between an outlet in the BTE housing behind the ear and the ear plug. Due to the finite speed of sound, and the fact that the vent is arranged within the ear plug, the length of the tubing will have an influence on the timing of the phase-inverted, predetermined audio signal emitted by the receiver in order to cancel out the sound emitted by the vent when the vent valve device is manipulated. The magnitude of this variation in timing of the phase-inverted, predetermined audio signal is of a magnitude of approximately 30 μs per centimeter difference in distance between the receiver and the sound outlet of the ear plug.

In some embodiments, the phase-inverted version of the predetermined audio signal is adapted to substantially cancel out the sound emitted by the vent valve device whenever the vent valve device is manipulated. This requires that the phase-inverted version of the predetermined audio signal be matched closely to the sound emitted by the vent valve device with respect to amplitude, timing, and phase alignment. This task is beneficially handled by the signal processor generating both the first signal to the controller for manipulating the vent valve device and the predetermined audio signal for the receiver emitting the phase-inverted version of the predetermined audio signal in order to cancel out the sound of the vent valve device emitted by the vent. When the sound emitted by the vent is cancelled out in this way, the user may not even notice that the vent is being opened or closed, apart from the effects of simply having an open or a closed vent, respectively, as discussed earlier.

In an embodiment, the predetermined audio signal is obtained during manufacture of the hearing device and the predetermined audio signal is stored in the memory, accessible to the signal processor of the hearing device. This has the advantage that vent click compensation is fully functional from the moment the hearing device is put into service. By determining the sound of the vent valve device by measurements e.g. in an acoustic coupler in a soundproof box in a sound lab, measurements may be performed during product development of the hearing device and the sound emitted by the vent when the vent valve device is manipulated may be recorded and stored in the memory of the hearing device. The hearing device is then configured to emit phase-inverted versions of these sounds by the receiver whenever the vent valve device is manipulated.

In most cases, obtaining the predetermined audio signal during manufacture of the hearing device provides an adequate vent click compensation, but in some situations it might be beneficial to have e.g. a healthcare professional assist in obtaining the predetermined audio signal in situ. Some hearing devices has a second microphone adjacent to the receiver positioned within the ear plug, e.g. for active noise reduction, a hearing device anti-feedback system (DFS) or occlusion cancellation purposes. The in-the-ear-microphone may beneficially be put into service and configured for the purpose of picking up the sound emitted by the vent when the vent valve device is manipulated.

In some embodiments, the ear plug comprises a second microphone adjacent to the receiver. The second microphone is configured for picking up a sound emitted by the vent when the vent valve device is manipulated, and that the hearing device is configured to store a representation of said sound picked up by the second microphone as the predetermined audio signal in the memory, accessible to the signal processor of the hearing device. By using an in-the-ear-microphone pointing towards the eardrum of the user for this purpose while the ear plug is positioned in the ear, recordings of the sound of the vent valve device being manipulated may be carried out, e.g. by a healthcare professional during a fitting session, and the resulting sounds may then be stored as the predetermined audio signal in the memory of the hearing device to be reproduced as a phase-inverted version of the predetermined audio signal by the hearing device receiver. The sound of the vent valve device being manipulated to the open position may be recorded separately from the sound of the vent valve device being manipulated to the closed position in order for the hearing device to distinguish between the two situations and reproduce the corresponding, phase-inverted version of the predetermined audio signal by the hearing device receiver.

According to some embodiments, the hearing device comprises a wireless transceiver for receiving wireless remote-control signals for operating the hearing device. The hearing device preferably includes several, selectable hearing programs adapted for different listening purposes such as quiet surroundings, traffic noise, conversation, listening to music etc. The various programs are selectable thanks to the presence of a wireless remote-control device for generating and transmitting the remote-control signals as desired by the user. The wireless remote-control device may be a dedicated, wireless remote-control device or e.g. a remote-control app running on a smartphone or similar consumer device. The wireless remote-control signals may e.g. be program-select commands or volume-change commands, or it may be commands to open or close the vent valve device in the vent of the ear plug of the hearing device. Each command activates a set of predefined instructions to be performed by the hearing device operating system. If the received command is a command to change to a particular program, the predefined set of instructions could be configured to change various parameters in the signal processor of the hearing device or configured to turn certain functions on or off, e.g. feedback cancellation.

Some program-select commands may inherently include an instruction to manipulate the vent valve device when a particular program is selected. For instance, one hearing program tailor-made for conversation purposes may include an instruction to open the vent by manipulating the vent valve device to the open position, since an open vent is deemed beneficial in that situation, while another hearing program tailor-made for listening to music may instead include an instruction to close the vent by manipulating the vent valve device to the closed position, thus providing the benefits of a closed vent to the user when this program is selected. Commands to simply open or close the vent upon request may, of course, also be made available to the user.

According to a second aspect, a method of operating a hearing device is devised, said hearing device comprising a first microphone, a signal processor, a memory, a receiver, and a controller for manipulating the position of a vent valve device positioned within a vent formed in an ear plug of the hearing device, the method involving the steps of; obtaining predetermined audio signal representing a sound of the vent when the vent valve device changes position, storing the predetermined audio signal in the memory, providing a first signal from the signal processor to the controller to manipulate the vent valve device, and output a phase-inverted version of the predetermined audio signal to the receiver substantially at the same time as the vent valve device is manipulated. In this way, the hearing device is capable of compensating for the sound emitted by the vent when the vent valve device is manipulated.

In some embodiments, the step of obtaining the representation of the sound of the vent when the vent valve device changing position from the open position to the closed position is separate from the step of obtaining the representation of the sound of the vent when the vent valve device changing position from the closed position to the open position. When the vent valve device closes, the air pressure in the ear canal will typically rise suddenly. Thanks to the phase-inverted version of the predetermined audio signal, the receiver provides a corresponding sudden drop in air pressure when the vent valve device closes in order to compensate for the sound emitted by the vent. However, when the vent valve device opens, the air pressure in the ear canal will typically fall suddenly instead, and in this case the receiver provides a corresponding sudden rise in air pressure when the vent valve device opens in order to compensate for the sound emitted by the vent. In this way, the hearing device advantageously provides compensation for the sound emitted by the vent both when the vent valve device is opening and when the vent valve device is closing.

In some embodiments, the step of obtaining a representation of the sound of the vent when the vent valve device when the vent valve device changes position is performed during manufacture of the hearing device and involves the steps of determining a sound of the vent valve device changing position, converting the determined sound into a representation suitable for storage, and storing the representation in non-volatile memory accessible to the signal processor of the hearing device. This has several advantages. The representation of the sound of the vent valve device being manipulated is obtained as a sound recording performed in a controlled manufacturing environment before being digitized and stored in the memory of the hearing device ready for use, possibly at the same time as the hearing device operating system and/or the initial settings of the hearing device are stored in the memory of the hearing device. This permits the vent click compensation to be carried out unobtrusively during fitting and use of the hearing device, without the healthcare professional worrying about it being set up incorrectly and without the user even noticing that the vent gives off a sound when the vent valve device is opening or closing.

The representation of the sound of the vent valve device being manipulated obtained during manufacture of the hearing device may be adequate for the majority of hearing device users, but in some cases, an actual vent valve device being manipulated in a particular hearing device may give off a sound deviating too much from the 'standard' vent click compensation signal stored in the hearing device, thus giving off a less-than-ideal compensation sound. This may, for instance, be the case if the ear canal has an unusual size or shape deviating too much from the 'ideal' conditions recorded for the hearing device during manufacture.

In order to provide vent click compensation in those cases, in some embodiments, the step of obtaining a representation of the sound of the vent valve device when the vent valve device changes position is performed during fitting of the hearing device and involves the steps of providing a second microphone adjacent to the receiver, manipulating the vent valve device to change position using the controller, picking up the sound of the vent valve device changing position using the second microphone, converting the sound from the second microphone into a representation suitable for storage, and storing the representation in non-volatile memory accessible to the signal processor of the hearing device. This enables a healthcare professional to instruct the hearing device to manipulate the vent valve device in situ and record the sound thus produced using the second microphone and the signal processor of the hearing device itself. The recordings are then stored in the hearing device memory by the healthcare professional (preferably using a special mode provided by the hearing device, the special mode typically being exclusively accessible from the fitting software) and the resulting vent click compensation sound may consequently be matched perfectly to the actual sound of the vent valve device in situ, resulting in a more accurate vent click compensation.

In some embodiments, the method involves that a wireless transceiver is provided in the hearing device, the method comprising the steps of receiving an instruction to manipulate the vent valve device via the wireless transceiver, generate the first signal from the signal processor to the controller for manipulating the vent valve device, and generate the predetermined audio signal representing a phase-inverted version of the sound of the vent valve device changing position to the receiver. This provides the benefit of using the signal processor to both manipulate the vent and simultaneously provide the vent click compensation signal. An easy and reliable method of providing vent click compensation while manipulating the vent valve device is hereby obtained.

BRIEF DESCRIPTION OF THE DRAWINGS

The hearing device is now described in greater details with respect to the drawings, wherein.

DETAILED DESCRIPTION

Figure 1:
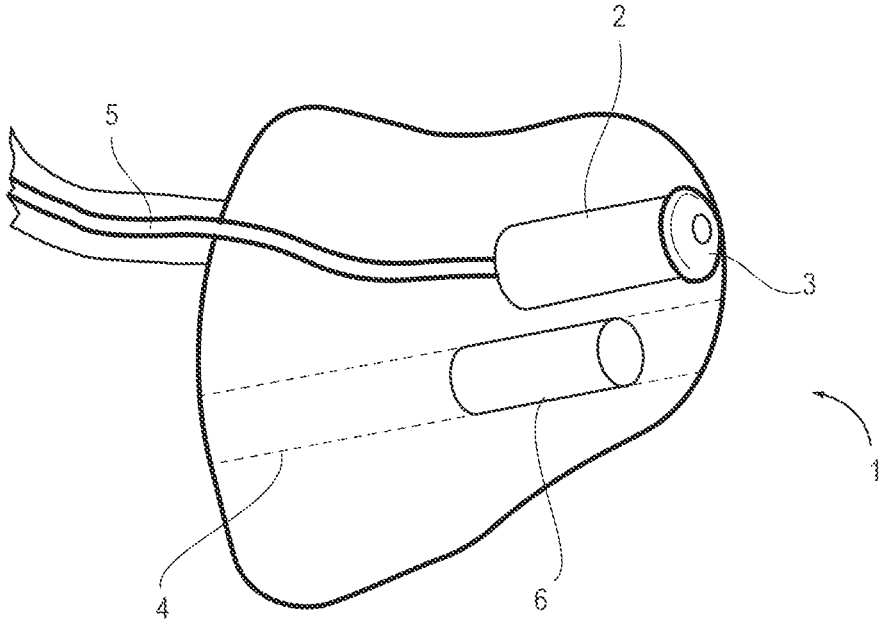
PRIOR ART Fig. 1
FIG. 1 shows a prior art hearing device having an active vent.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows a prior art ear plug 1 intended for a hearing device, having a receiver 2 for reproducing sounds for a user. The receiver 2 has an exchangeable wax guard 3 mounted in an opening (not shown) in front of the receiver 2. The purpose of the wax guard 3 is to prevent cerumen and moisture from the ear canal of the user to enter the ear plug 1, potentially damaging the receiver 2. Adjacent to the receiver 2 is a vent 4 having a vent valve device 6. The vent valve device 6 may change the acoustic impedance of the vent 4 by assuming one of two positions: One position corresponding to an open vent, and another position corresponding to a closed vent. The position of the vent valve device 6 is preferably manipulated electrically. The receiver 2 is connected to a hearing device (not shown in FIG. 1) via a receiver wire 5 for receiving an electrical signal representing sound to be reproduced acoustically by the receiver 2.

During use, the vent valve device 6 may, in a first example, be in the position corresponding to an open vent. This provides the user with both the benefits end the disadvantages of a hearing device having a vent. In some cases, e.g. when listening to music, a vent may be a disadvantage to the user, e.g. due to the poor low-frequency reproduction of sounds associated with a vent, as stated earlier. In this case, the user may beneficially instruct the hearing device to move the vent valve device 6 to the position corresponding to a closed vent, advantageously performing the instruction by selecting a hearing device program among a plurality of available hearing device programs, said selected hearing device program comprising an internal instruction to close off the vent 4 by moving the vent valve device 6 to the position corresponding to a closed vent. In another case, the user may wish for the vent 4 to be open and thus select another hearing device program comprising an internal instruction to move the vent valve device 6 to the position corresponding to an open vent. Such a program may, beneficially, be tailored to have the hearing device perform optimally in e.g. conversational situations where e.g. the occlusion effect associated with a closed or absent vent may present problems for the user.

Despite the obvious benefits of having an active vent in a hearing device there exists at least one drawback: The vent valve device 6 generates an air pressure wave, i.e. a sound, whenever the vent valve device 6 is opened or closed due to the occurrence of an inherent momentary change in air pressure within the ear canal of the user wearing the hearing device with the ear plug 1 placed in his or her ear canal due to the manipulation of the vent valve device 6. This sound may present itself as a popping or clicking sound which may be very discomforting to the user wearing the hearing device while the vent valve device 6 is being opened or closed.

Figure 2:
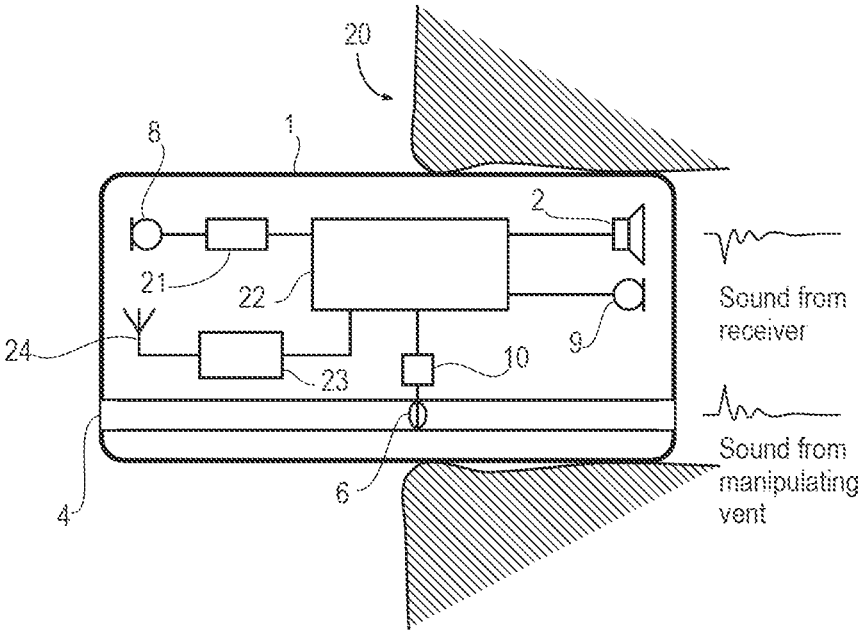
FIG. 2 shows a principle block schematic of a hearing device with vent click compensation.

FIG. 2 illustrates schematically an ear plug 1 shown as an embodiment of an ITE hearing device. The hearing device is adapted for alleviating a clicking sound emitted by a vent valve device when it is opened or closed. During use, the ITE hearing device is placed in an ear canal of a user and is held in place partly by the shape of part of a user's outer ear 20 and partly by the shape of the ear canal itself. The ear plug 1 comprises an external microphone 8 for picking up acoustic signals from the surroundings and converting the acoustic signals into electrical signals. The external microphone 8 is connected to an A/D converter 21 for converting the electrical signals from the external microphone 8 into digital signals. The digital signals from the A/D converter 21 are output to a first input of a signal processor 22. The signal processor 22 is adapted to provide amplification of the signals picked up by the external microphone 8 according to a hearing loss prescription for the purpose of alleviating a hearing loss of the user by performing various computational operations on the digital signals from the A/D converter 21. The amplified signals are converted into a form suitable for being presented to a receiver 2, which is configured to convert the amplified signals into acoustic signals for the user to hear. A wireless transceiver 23 is configured to receive wireless signals picked up by an antenna 24 and convert the wireless signals into electrical signals which are fed to a second input of the signal processor 22. The wireless signals may e.g. be remote control signals or audio streaming signals intended for reproduction by the ITE hearing device.

For reasons discussed in the foregoing, a vent 4 is embedded in the ear plug 1. The vent 4 is formed as a through-going canal in the body of the ear plug 1 and provides the ITE hearing device with an acoustic path from the outside of the ear plug 1 to the part residing within the ear canal of the user during use. The vent 4 has a vent valve device 6 capable of closing or sealing off the acoustic path provided by the vent 4. The vent valve device 6 is activated by a vent valve device controller 10 controlled by a dedicated, electrical output signal from the signal processor 22. Preferably, the vent valve device controller 10 is a binary device capable of manipulating the vent valve device 6 into one of two possible positions; Open or closed. This has the inherent advantage that the vent valve device controller 10 only draws current from the hearing device battery (not shown in FIG. 2) when opening or closing the vent valve device 6, thus saving power when manipulating the vent valve device 6. In some embodiments, information on the current position of the vent valve device 6 is detected by the vent valve device controller 10 and the information of the current position of the vent valve device 6 is then conveyed to the signal processor 22.

The signal processor 22 controls the vent valve device 6 by applying a suitable, electrical signal to the vent valve device controller 10, thereby closing the vent valve device 6 if it is in the open position or opening the vent valve device 6 if it is in the closed position. When the vent valve device 6 is manipulated in this manner, a sound is emitted from the vent 4 due to the momentary change in the air pressure in the ear canal as indicated in FIG. 2. In order to counteract the sound thus emitted by manipulating the vent valve device 6, the signal processor 22 is configured to simultaneously send out a predetermined audio signal substantially identical to the sound emitted from the vent 4, but of opposite phase. The two sounds then cancel each other out. Thus, ideally, when the air pressure contribution from the vent 4 increases, the air pressure contribution from the receiver 2 decreases correspondingly, and vice versa.

The net result of sending out a phase-inverted, predetermined sound from the receiver 2 at the same time as opening or closing the vent valve device 6 is that the combined contributions in air pressure change from the vent 4 and the receiver 2, respectively, sums to zero in the ear canal of the user, thus reducing or eliminating the sound emitted from the vent 4 during opening or closing the vent valve device 6.

The predetermined sound is stored in the hearing device memory (not shown in FIG. 2) accessible to the signal processor 22 and may, in some embodiments, be embedded into the software code to be executed by the signal processor 22 during manufacture of the hearing device. The opening or closing of the vent valve device 6 is usually carried out by the hearing device operating system as a result of receiving a wireless command via the wireless transceiver 23, e.g. from a wireless remote control (not shown in FIG. 2) of the hearing device. The command may either be a direct command instructing the vent valve device controller 10 to manipulate the vent valve device 6, or it may be a command to select another program in the hearing device different from the program currently being executed, said different program requiring the vent valve device 6 to assume the other position, i.e. being opened if it is closed, or vice versa, dependent on its current position. In both cases, the signal processor 22 is configured to obtain the predetermined sound from the hearing device memory and output a phase-inverted version of the predetermined sound to the receiver 2 to coincide with the signal processor 22 sending an activation signal to the vent valve device controller 10. Preferably, the predetermined sound is a first predetermined sound of the vent 4 when the vent valve device 6 is opened and a second predetermined sound of the vent 4 when the vent valve device 6 is closed.

In an alternative embodiment, no predetermined sound is stored in the hearing device memory of the signal processor 22 during manufacture. Instead, a health care professional instructs the vent valve device controller 10 to open and close the vent valve device 6, respectively, in situ during fitting of the hearing device, respectively, so that the vent 4 emits a sound in either case. This instruction may e.g. be given by activating a special mode in the hearing device, said special mode preferably being made available as an option in the fitting software used by the healthcare professional to fit the hearing device to suit the user's hearing loss and other needs. The sound emitted by the vent 4 when the vent valve device 6 is opening or closing is then picked up by an internal microphone 9 of the hearing device and subsequently stored as a representation of a set of predetermined sounds in the hearing device memory for later, phase-inverted reproduction as an acoustic signal by the receiver 2 whenever the vent valve device 6 is manipulated, as suggested by the curves denoted 'Sound from receiver' and 'Sound from manipulating vent', respectively, in FIG. 2. This has the added benefit of enabling adaptation of the predetermined sound to various configurations of the size and shape of the ear plug 1, the vent 4, and the corresponding dimensions of the ear canal of the user. In this way it is ensured that the phase-inverted version of the predetermined sound generated by the receiver 2 is individually optimized with respect to the sound emitted by the vent 4.

Figure 3:
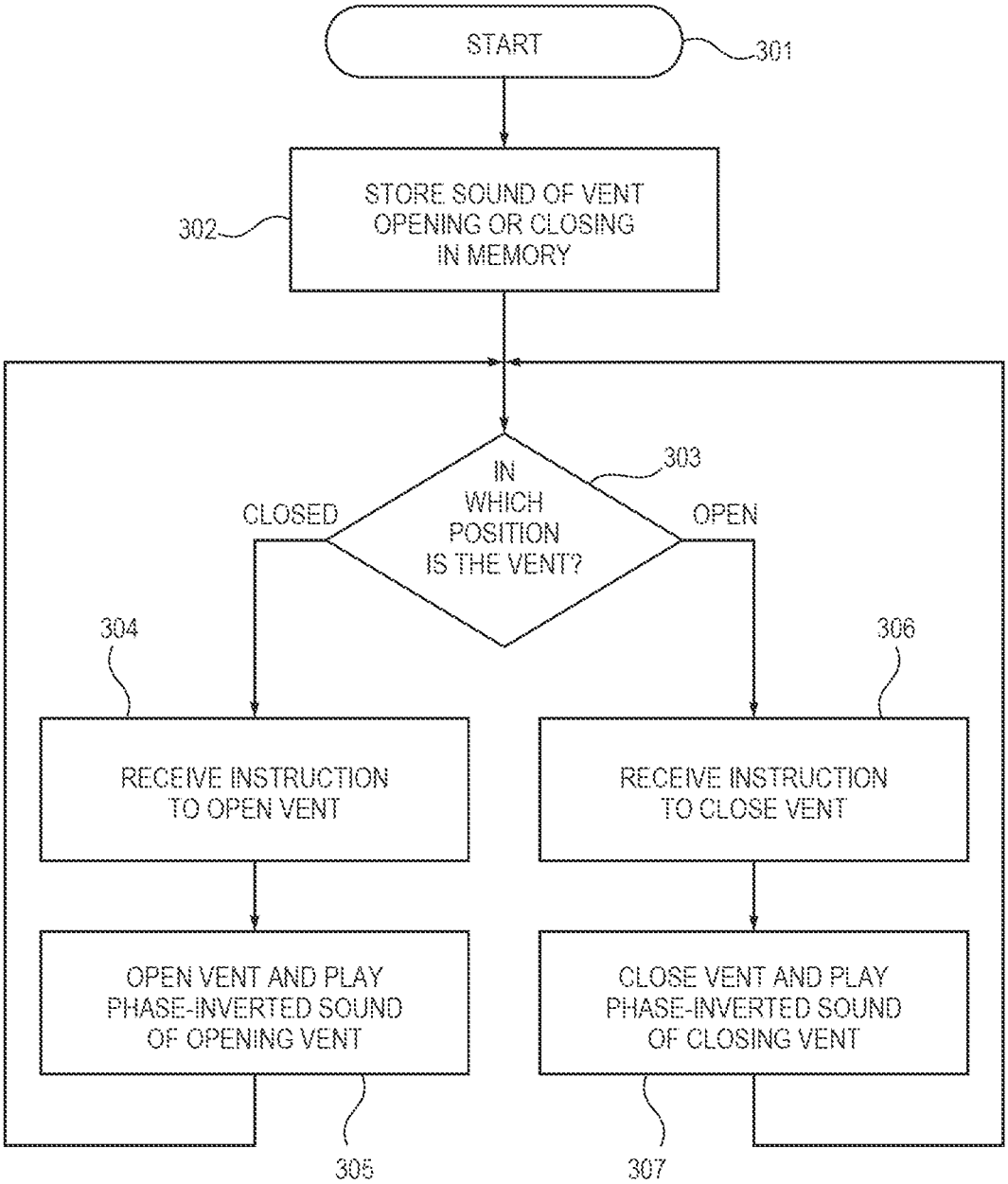
FIG. 3 shows a flowchart illustrating providing an anti-phase sound in a hearing device.

The procedure for compensating the sound of an active vent 4 in an ear plug 1 is now described in more detail with reference to FIGS. 2 and 3. FIG. 3 is a flowchart illustrating a method (such as an algorithm) for the application of a phase-inverted sound to reduce or eliminate a sound emitted by an active vent 4 in the signal processor 22 of a hearing device of the type shown in FIG. 2. In step 301 of the algorithm, the hearing device is initiated, a prescription for alleviating a hearing loss is loaded into the signal processor 22, and a default program is selected. In step 302, data representing the sound emitted by the vent 4 whenever the vent valve device 6 is manipulated is stored in the hearing device memory. It should be noted here that, in some embodiments, step 302 may be carried out during manufacturing of the hearing device, i.e. the data may already be present in the hearing device memory at the time the hearing device is put into service.

In step 303, the current position of the vent valve device 6 is determined. If the vent valve device 6 is in the closed position, the method or algorithm branches out to step 304, where an instruction to open the vent 4 is expected by the signal processor 22. When an instruction to open the vent 4 is received, the method or algorithm proceeds to step 305, where the signal processor 22 sends a signal to the vent valve device controller 10 and, coincidentally, sends out the phase-inverted, predetermined sound corresponding to the sound of the vent valve device 6 opening. The method or algorithm then returns to step 303 to update the open position of the vent valve device 6 as the current state.

If the vent valve device 6 is determined to be in the open position in step 303, the method or algorithm instead branches out to step 306, where an instruction to close the vent 4 is expected by the signal processor 22. When an instruction to close the vent 4 is received, the method or algorithm proceeds to step 307, where the signal processor 22 sends a signal to the vent valve device controller 10 and, coincidentally, sends out the phase-inverted, predetermined sound corresponding to the sound of the vent valve device 6 closing. The method or algorithm then returns to step 303 to update the closed position of the vent valve device 6 as the current state.

Figure 4A:
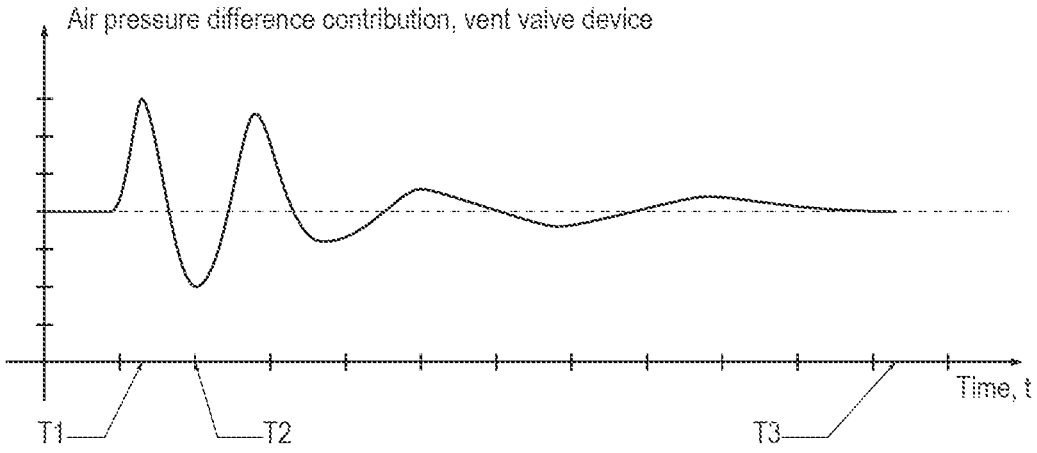
FIG. 4*a* and FIG. 4*b* are timing diagrams showing concurrency of a vent sound and an anti-phase sound.

FIG. 4*a* is a timing diagram showing an example of a sound emitted by a vent 4 when a vent valve device 6 therein is closing the vent, with reference to the embodiment shown in FIG. 2. The timing diagram has time marked along the x-axis and the air pressure marked along the y-axis. The scaling of the x-axis is chosen arbitrarily but may be e.g. 1 ms/mark or 100 ms/mark, preferably 10 ms/mark, in FIGS. 4*a* and 4*b*. When a signal to close the vent 4 is sent out at t=0, the vent valve device 6 exhibits a delay, mainly due to mechanical limitations, before it starts to move and the air pressure contribution from the vent 4 rises as a result until reaching a local maximum at time t=T1, where it begins to fall again. At time t=T2, the air pressure contribution from the vent 4 has dropped significantly below the nominal air pressure, reaching a local minimum. The air pressure contribution from the vent 4 then fluctuates up and down a few times in a damped vibration before settling at the nominal air pressure at t=T3.

Figure 4B:
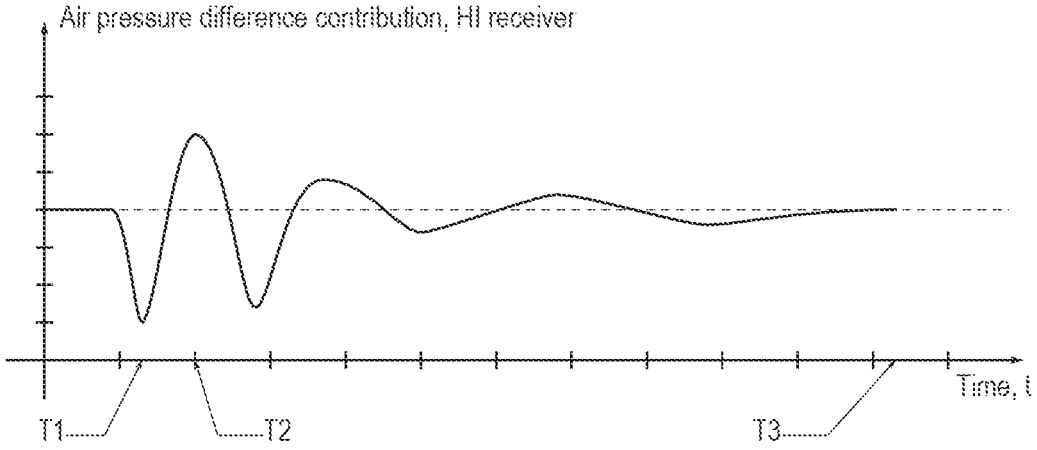

FIG. 4*b* is a timing diagram showing an example of the phase-inverted, predetermined sound emitted by a receiver 2 to counteract a sound emitted by the vent 4 when the vent valve device 6 is closing, with reference to the embodiment shown in FIG. 2. The timing diagram is aligned with the timing diagram in FIG. 4*a* for clarity, and the units are the same as the units in FIG. 4*a*. At t=0, the delay of the vent valve device 6 is mimicked by delaying the phase-inverted, predetermined sound from the receiver 2 a corresponding period before making the diaphragm of the receiver 2 move in the opposite direction of the vent valve device 6, and the air pressure contribution from the receiver 2 reproducing the phase-inverted, predetermined sound thus falls until it reaches a local minimum at time t=T1, where it begins to rise again. At time t=T2, the air pressure contribution from the receiver 2 has risen significantly above the nominal air pressure, reaching a local maximum. The air pressure contribution from the receiver 2 then continues to follow the opposite movements of the vent valve device 6 before settling at the nominal air pressure at t=T3.

Together, the contribution in air pressure change from the vent 4 and the receiver 2 cancel each other out due to the fact that the outlet of the vent 4 and the outlet of the receiver 2 are both confined to the closed volume of the ear canal of the user. Thus, the unpleasant sound which may be experienced by the user when the vent valve device 6 is manipulated is hereby eliminated or at least greatly reduced while preserving the benefits of an active vent, as discussed previously.

Figure 5A:
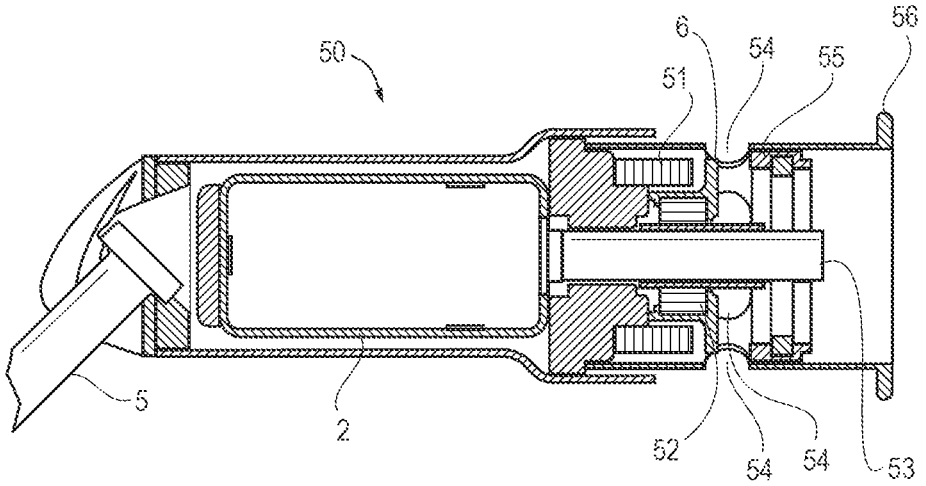
FIG. 5*a* illustrates a longitudinal cut through an ear plug having an active vent in an open position.
Figure 5B:
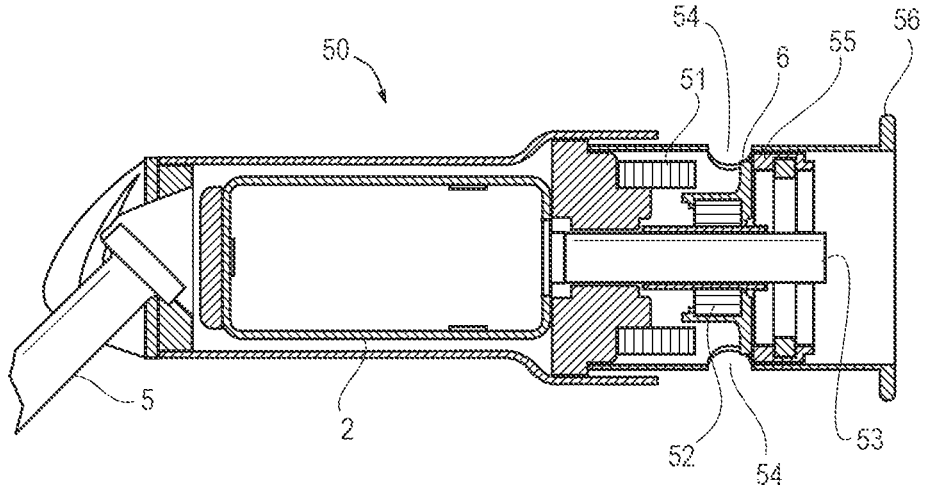
FIG. 5*b* illustrates a longitudinal cut through an ear plug having an active vent in a closed position.

FIGS. 5*a* and 5*b* illustrates a longitudinal cut through a receiver housing 50 having an active vent, according to an embodiment. The receiver housing 50 has a substantially cylindrical shape and comprises a receiver 2 connected to hearing device circuitry (not shown) via a receiver wire 5 at the distal end of the receiver housing 50 and connected to one end of a receiver sound outlet tube 53 at the proximal end of the receiver housing 50. The other end of the receiver sound outlet tube 53 is held in place by a vent outlet 55. The active vent comprises a solenoid coil 51 and a permanent magnet 52 mounted on a vent valve device 6. The magnet 52 may be a toroidal magnet. A plurality of vent inlets 54 are dispersed in the receiver housing wall between the solenoid coil 51 and the vent outlet 55. The vent outlet 55 is embodied as a ring or inner bushel restricting the inner diameter of the proximal end of the receiver housing 50. A flange 56 is arranged at the proximal end of the receiver housing 50. The purpose of the flange 56 is to form a seal between an ear plug (not shown) and the receiver housing 50 when the receiver housing is mounted in the ear plug, e.g. in the manner illustrated in FIG. 1.

The vent valve device 6 is configured to move between a first, open position, shown in FIG. 5*a*, and a second, closed position, shown in FIG. 5*b*. The vent valve device 6 and the permanent magnet 52 are mounted together on the receiver sound outlet tube 53 in a way that facilitates a sliding motion of the vent valve device 6 between the first, open position and the second, closed position. The sliding motion is initiated by applying an electric current to the solenoid coil 51 for creating a magnetic field attracting or repelling the permanent magnet 52. An electric current through the solenoid coil 51 in one direction attracts the permanent magnet 52, thereby opening the vent, and an electric current in the opposite direction through the solenoid coil 51 repels the permanent magnet 52, thereby closing the vent.

In the first, open position of the vent valve device 6 shown in FIG. 5*a*, the solenoid coil 51 attracts the permanent magnet 52 towards the distal end of the receiver housing 50, thereby creating a passageway for air to flow between the plurality of vent inlets 54 and the vent outlet 55. Thanks to the sealing between the ear plug (not shown) and the receiver housing 50, said passageway is the only way air can escape an ear canal (not shown) when the ear plug and the receiver housing 50 is mounted in its intended place in the ear canal.

In the second, closed position of the vent valve device 6 shown in FIG. 5*b*, the solenoid coil 51 repels the permanent magnet 52 towards the proximal end of the receiver housing 50, thereby closing said passageway between the plurality of vent inlets 54 and the vent outlet 55. When the edge of the vent valve device 6 abuts the rim of the vent outlet 55, the vent valve device 6 and the vent outlet 55 forms a seal trapping the air in the ear canal from the exterior.

When the vent valve device 6 reaches the second, closed position as illustrated in FIG. 5*b*, it gives off a first clicking sound when it hits an end stop. According to several embodiments, this first clicking sound may be compensated by having the signal processor of the hearing device (not shown) simultaneously provide a predetermined, first sound signal to the receiver 2 cancelling out the clicking sound of the vent valve device 6.

When the vent valve device 6 reaches the first, open position as illustrated in FIG. 5*a*, it gives off a second clicking sound when it hits the rim of the vent outlet 55. According to several embodiments, this second clicking sound may be compensated by having the signal processor of the hearing device simultaneously provide a predetermined, second sound signal to the receiver 2 cancelling out the second clicking sound of the vent valve device 6.

In this way, a hearing device capable of compensating clicking sounds emitted by an active vent whenever the active vent is manipulated, is devised.

LIST OF PARTS

1. Ear plug
2. Receiver
3. Wax guard
4. Vent
5. Receiver wire
6. Vent valve device
8. External microphone
9. Internal microphone
10. Vent valve device controller
20. Part of outer ear
21. A/D converter
22. Signal processor
23. Wireless transceiver
24. Antenna
50. Receiver housing
51. Solenoid coil
52. Toroidal magnet
53. Receiver sound outlet tube
54. Vent inlet
55. Vent outlet
56. Flange
301. Start
302. Store sound
303. Check vent position
304. Closed; receive instruction to open vent
305. Closed; open vent and play sound of opening vent
306. Open; receive instruction to close vent
307. Open; close vent and play sound of closing vent

The invention claimed is:

1. A hearing device having an ear plug for insertion into an ear canal of a user of the hearing device, the hearing device comprising:

a first microphone;
a signal processor;
a memory;
a controller; and
a receiver;

wherein the ear plug comprises a vent having a vent valve device configured to open or close the vent, the controller being configured to manipulate the vent valve device to a first position or a second position based on a first signal from the signal processor;

wherein the hearing device is configured to obtain a predetermined audio signal representing a sound emitted by the vent when the vent valve device is manipulated between the first position and the second position, and wherein the predetermined audio signal is stored in the memory; and wherein the signal processor is configured to access the predetermined audio signal in the memory, and to output a phase-inverted version of the predetermined audio signal to the receiver substantially at a same time as the vent valve device is manipulated.

2. The hearing device according to claim 1, wherein the phase-inverted version of the predetermined audio signal output by the signal processor when the vent valve device is manipulated to the first position is different from the phase-inverted version of the predetermined audio signal output by the signal processor when the vent valve device is manipulated to the second position.

3. The hearing device according to claim 1, wherein the receiver is in the ear plug.

4. The hearing device according to claim 1, wherein the first position of the vent valve device is an open position, and the second position of the vent valve device is a closed position.

5. The hearing device according to claim 1, wherein the first position of the vent valve device is a closed position and the second position of the vent valve device is an open position.

6. The hearing device according claim 1, wherein the phase-inverted version of the predetermined audio signal is configured to at least partially or completely cancel out sound emitted by the vent valve device whenever the vent valve device is manipulated.

7. The hearing device according to claim 1, wherein the predetermined audio signal is obtained during manufacture of the hearing device, and wherein the predetermined audio signal stored in the memory is accessible to the signal processor of the hearing device.

8. The hearing device according to claim 1, wherein the ear plug comprises a second microphone, wherein the second microphone is configured to pick up the sound emitted by the vent when the vent valve device is manipulated, and wherein the hearing device is configured to store a representation of the sound picked up by the second microphone as the predetermined audio signal in the memory.

9. The hearing device according to claim 1, further comprising a wireless transceiver.

10. The hearing device according to claim 9, wherein the wireless transceiver is configured to receive at least one instruction from an external device, the at least one instruction causing the signal processor to send the first signal to the controller for manipulating the vent valve device, and to output the phase-inverted version of the predetermined audio signal to the receiver substantially at the same time as the vent valve device is manipulated.

11. A method of operating a hearing device comprising a first microphone, a signal processor, a memory, a receiver, and a controller for manipulating a vent valve device in a vent of an ear plug of the hearing device, the method comprising:

obtaining a predetermined audio signal representing a sound of the vent when the vent valve device changes position, wherein the predetermined audio signal is stored in the memory;

providing a first signal from the signal processor to the controller to manipulate the vent valve device; and outputting a phase-inverted version of the predetermined audio signal to the receiver substantially at a same time as the vent valve device is manipulated.

12. The method according to claim 11, wherein the predetermined audio signal corresponding the vent valve device changing from an open position to a closed position is different from the predetermined audio signal corresponding with the vent valve device changing from the closed position to the open position.

13. The method according to claim 11, wherein the predetermined audio signal is obtained during manufacture of the hearing device, and wherein the predetermined audio signal is obtained by:

determining the sound of the vent valve device changing position; and converting the determined sound into the predetermined audio signal.

14. The method according to claim 11, wherein the act of obtaining the predetermined audio signal is performed during fitting of the hearing device, and wherein the act of obtaining the predetermined audio signal comprises:

manipulating the vent valve device to change position;

picking up the sound of the vent valve device changing position using a second microphone; and converting the sound from the second microphone into the predetermined audio signal.

15. The method according to claim 11, wherein the hearing device comprises a wireless transceiver, and wherein the method further comprises receiving an instruction to manipulate the vent valve device via the wireless transceiver.

* * * * *